US008157967B2

(12) United States Patent
Pekkarinen et al.

(10) Patent No.: US 8,157,967 B2
(45) Date of Patent: Apr. 17, 2012

(54) ARRANGEMENT IN CONNECTION WITH SCREENING APPARATUSES

(75) Inventors: Marko Pekkarinen, Anjalankoski (FI); Eero Honkala, Kotka (FI)

(73) Assignee: Andritz Oy, Helsinki (FI)

( * ) Notice: Subject to any disclaimer, the term of this patent is extended or adjusted under 35 U.S.C. 154(b) by 199 days.

(21) Appl. No.: 12/282,949

(22) PCT Filed: Mar. 16, 2007

(86) PCT No.: PCT/FI2007/000065

§ 371 (c)(1),
(2), (4) Date: Sep. 15, 2008

(87) PCT Pub. No.: WO2007/107620

PCT Pub. Date: Sep. 27, 2007

(65) Prior Publication Data

US 2009/0038769 A1 Feb. 12, 2009

(30) Foreign Application Priority Data

Mar. 17, 2006 (FI) ..... 20060258

(51) Int. Cl.
*D21F 1/32* (2006.01)

(52) U.S. Cl. ..... 162/274

(58) Field of Classification Search ..... 162/274, 162/380, 55; 209/240, 270, 306; 210/298, 210/415

See application file for complete search history.

(56) References Cited

U.S. PATENT DOCUMENTS 3,545,621 A * 12/1970 Lamort ..... 210/298
6,171,448 B1 * 1/2001 Iwashige ..... 162/380

FOREIGN PATENT DOCUMENTS

DE 10 2004 039 712 A1 3/2006
EP 0 933 468 A2 8/1999
GB 1 225 286 3/1971
WO WO 00/53845 A1 9/2000

OTHER PUBLICATIONS

International Search Report mailed May 24, 2007.

* cited by examiner

*Primary Examiner* — Mark Halpern
(74) *Attorney, Agent, or Firm* — Nixon & Vanderhye P.C.

(57) ABSTRACT

An arrangement in screening apparatuses of the pulp and paper industry, including a conduit for removing reject formed in a screening process. The circulation of material is arranged between the reject removal conduit and the interior of the screening apparatus from the removal conduit into the interior of the screening apparatus via a conduit external to the screening apparatus. When such a by-pass flow is arranged for pulp via external circulation, heavy particles in the layer being diluted are allowed to be separated onto the bottom of the reject removal conduit and therethrough e.g. into a separate junk trap.

5 Claims, 3 Drawing Sheets

ARRANGEMENT IN CONNECTION WITH SCREENING APPARATUSES

CROSS RELATED APPLICATIONS

This application is a 371 of PCT/FI07/00065 filed on 16 Mar. 2007 which designated the U.S. and claims benefit of Finnish Patent Application No. 20060258 filed 17 March 2006, the entire contents of these applications are hereby incorporated in their entireties by reference.

BACKGROUND OF THE INVENTION

The present invention relates to an arrangement in connection with reject removal from screening apparatuses of the pulp and paper industry. A screening apparatus comprises at least an outer housing, conduits therein for pulp to be fed in, for accept and for reject. The invention is especially applicable for screening apparatuses, in which heavy reject fraction is removed from the fibrous pulp being treated, such as recycled pulp. This kind of reject removal conduit is often provided with a junk trap.

A reject removal technique has been developed from the screening apparatus and thus enhance the operation thereof in pulp cleaning. A problem in reject removal may on one hand be the passing of high quality fibrous material into the reject and on the other hand the disturbance caused by reject particles for the passing of the accept through the screening surface.

The concept of external circulation, in the present context, refers to a flow external in view of the main apparatus, the screening apparatus, in this case a flow passing outside the body of the screening apparatus, but without essentially changing the total pulp flow into and out of the screening apparatus and without having any direct contact with another process or process stage. The main apparatus is thus the actual screening apparatus, wherefrom a conduit leads to the external circulation and back therefrom. A device refers to this actual external circulation and possible mixing liquid pipes in connection therewith, such as a water pipe, and the flow taking place in the circulation.

The pulp flow through the device is increased such that the collection capability thereof for collecting reject particles, such as so-called junk, is intensified. If no flow-through via an external circulation is provided, non-pulp particles are in practice not allowed to pass through the static pulp layer into a junk trap or corresponding. When a by-pass flow is provided for the pulp via an external circulation so that the pulp is simultaneously preferably diluted, heavy particles in the layer being diluted are allowed to be separated onto the bottom of the reject removal conduit and therethrough into a separate junk trap, in case it is separately provided in the conduit. The arrangement has no effect on the operation of the junk trap known per se, but the operation of the junk trap is similar to that of known screening apparatuses with dilutions. Only the emptying interval of the junk trap may need to be changed to correspond to the amount of accumulating junk.

A typical screening apparatus comprises a vertical cylindrical screen rotating inside a housing. The outer surface of the screen and the inner surface of the housing of the screening apparatus define a pulp feed chamber, wherefrom the pulp flows into an accept chamber located inside the screen drum. The screening apparatus also comprises conduits connected to the housing for pulp, accept and reject flows. The inner surface of the housing may typically be provided with at least one so-called outer foil. For effecting the external material circulation, the outlet flow from the external circulation conduit is led in the feed chamber, preferably via the outer foil, to a zone with a low static pressure and the inlet flow into the external circulation is led to a zone having a static pressure slightly higher than in the other surroundings. The increase of the static pressure is due to the decelerating of the flow prior to the outer foil and, correspondingly, the decrease of the static pressure is due to the accelerating of the flow between the outer foil and the screen drum. The pressure difference provides for the required and essential flow in the external circulation. The outer foil may also be replaced by some other corresponding arrangement allowing to decrease the static pressure at that point of the screening apparatus.

Because the amount of water used for mixing is to be kept as small as possible, and on the other hand, the disturbance caused by the external circulation device to the main apparatus should be as insignificant as possible, the entering water must have a high velocity in order to provide good mixing.

The inlet of the external circulation is positioned in respect of the bottom of the body in such a way that it is only partly open, i.e. the inlet is lower than the bottom level. Thus, a step is formed, which prevents separated junk from getting back to the inside of the main apparatus. The rinsing water entering the junk trap further dilutes the entering pulp and thus washes off the remaining fibers from the junk. By means of valves the junk trap is purged into reject intermittently, and the junk trap in principle contains only low-fiber water and the junk to be removed.

SUMMARY OF THE DRAWINGS

A embodiment of the invention is described in more detail with reference to the accompanying figures, of which:

FIG. 1 illustrates part of the outer housing 1 of a screening apparatus, to which outer housing a reject removal conduit 2 with a junk trap 3 and the associated valves (details not illustrated) is connected. A device for the external circulation comprises an initial part 4 of the reject removal conduit and a pipe elbow 5 associated therewith. The inlet of the device for the external circulation is marked with 4*a* and the outlet with 5*a*. The inlet 4, 4*a* is sloping downwards from the horizontal direction. The lower edge 4*b* of the inlet is positioned in a distance below the bottom level 8 of the body 1 of the screening apparatus, whereby a step (9, FIG. 3) is formed therein, which step contributes to preventing heavy undesired particles from flowing back into the screening apparatus.

Mixing liquid, such as water, is introduced into the circulation via conduit 6. The junk trap receives dilution liquid in a way known per se via conduit 7.

Figure 1:
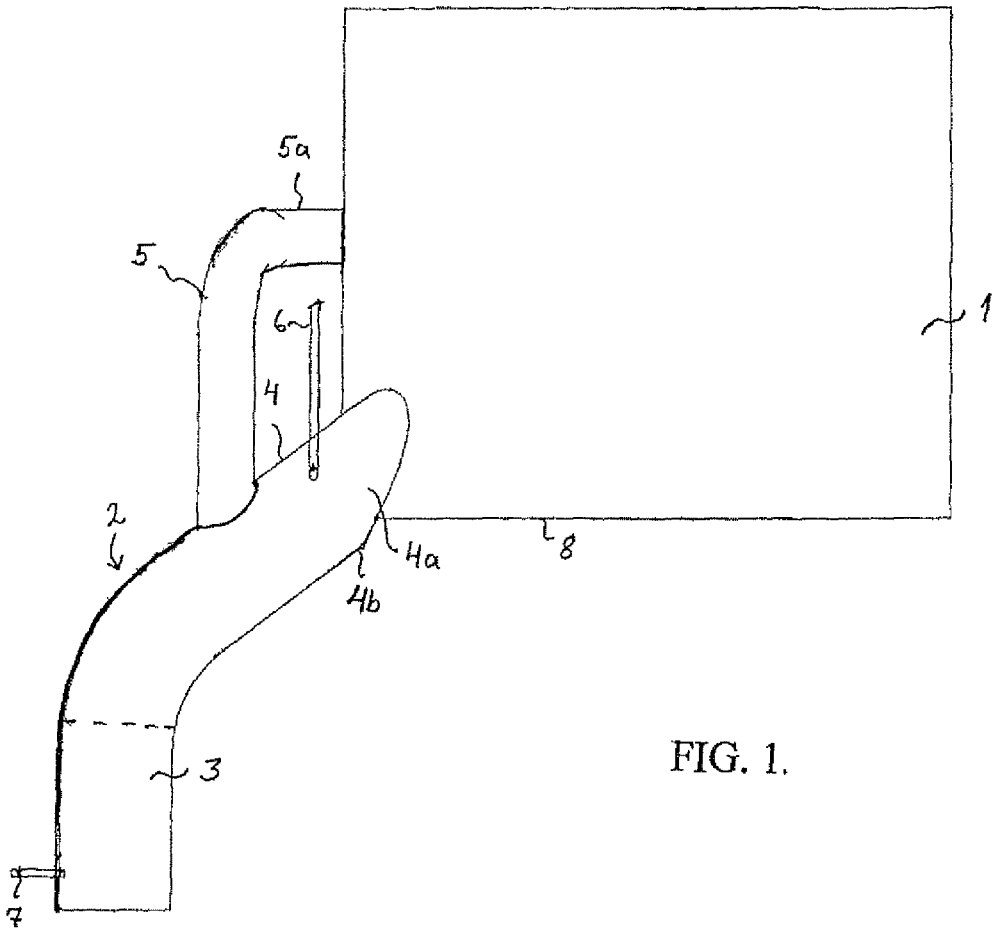
FIG. 1 illustrates schematically an arrangement of the external circulation of the screening apparatus according to the invention in side view.
Figure 2:
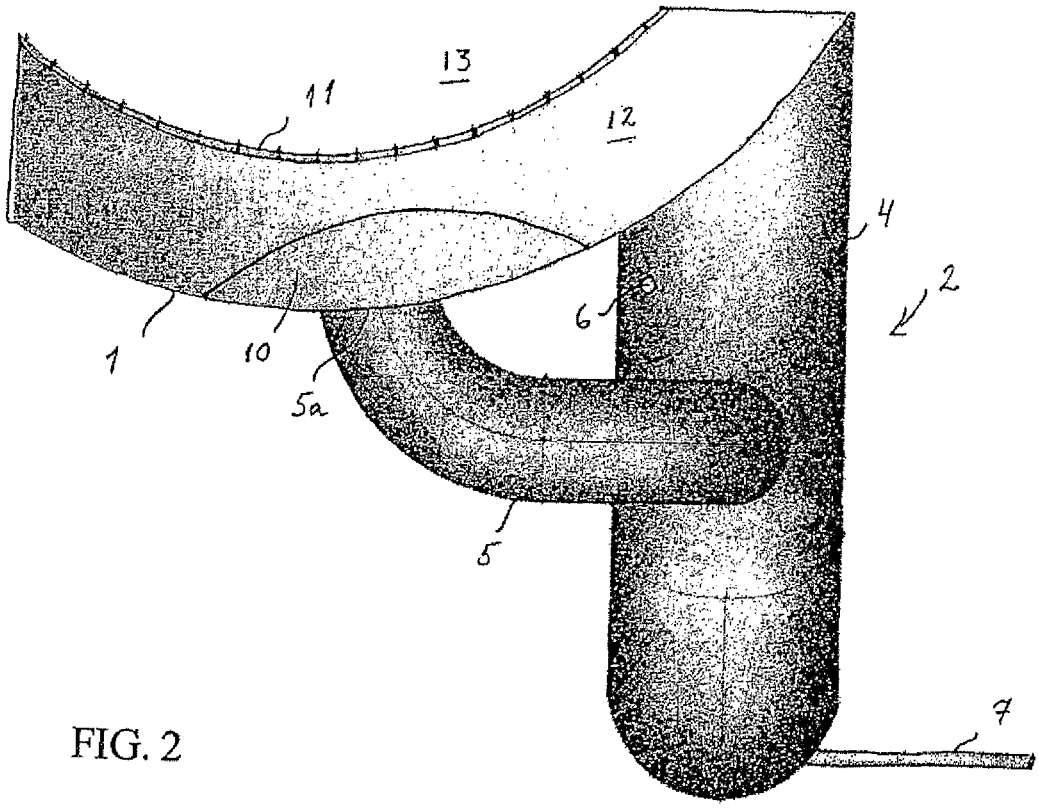
FIG. 2 illustrates schematically as a top view an arrangement of the external circulation of the screening apparatus according to the invention.

FIG. 2 illustrates the arrangement of FIG. 1 seen from the above. A typical screening apparatus may comprise a vertical rotating cylindrical screen 11. A pulp feed chamber 12 is defined by the outer surface of the screen drum and the inner surface of the housing of the screening apparatus, from which feed chamber the pulp flows into an accept chamber 13 located inside the screen drum. A so-called outer foil 10 is typically located on the inner surface of the housing. For providing the external material circulation, the outflow from the external circulation conduit 5*a* is led through the outer foil 10 in between the screen drum and the outer foil.

The model has been subjected to a flow-technical study. The rotation of the screen drum and the influence of the outer foil on the passing of the flows both in the apparatus and in the screen have been taken into account in the model. The consistency of the pulp in the model is 3%, i.e. mainly the viscosity and the density have been changed to correspond to a 3% pulp viscosity and density.

Figure 3:
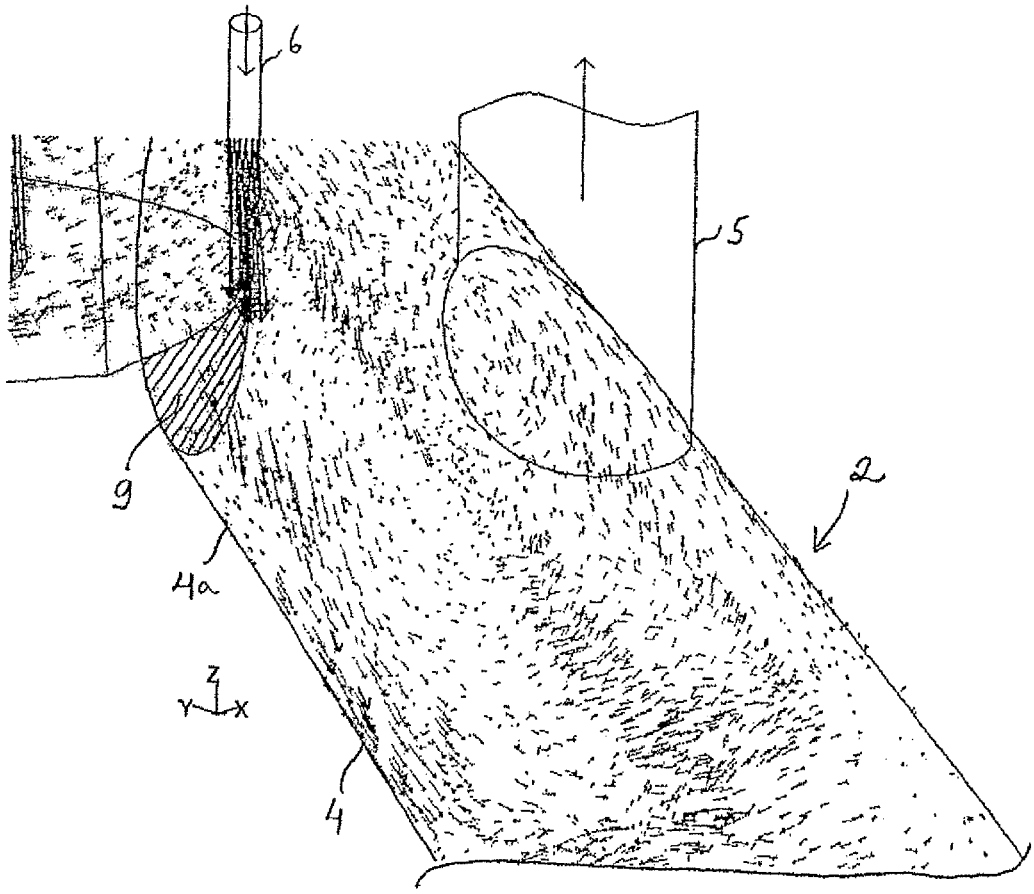
FIG. 3 illustrates a detail.

FIG. 3 illustrates a cut-away view of the inlet pipe 4*a*, 4 in the elevation direction. It may be noted in the vector diagrams that the mixing water 6 causes a longitudinal vortex in the inlet pipe so that at the start of the outlet pipe 5 the jet stream passes on the bottom of the inlet pipe 4, i.e. as far as possible in view of the passing of the junk under the suction effect of the outlet pipe 5. On the other hand, because of the hindrance caused by the suction and the mixing water jet from the inlet pipe, a vortex is formed in the initial part of the outlet pipe 5 directed in its axial direction, which contributes to the passing of heavy particles into the junk trap.

Figure 4:
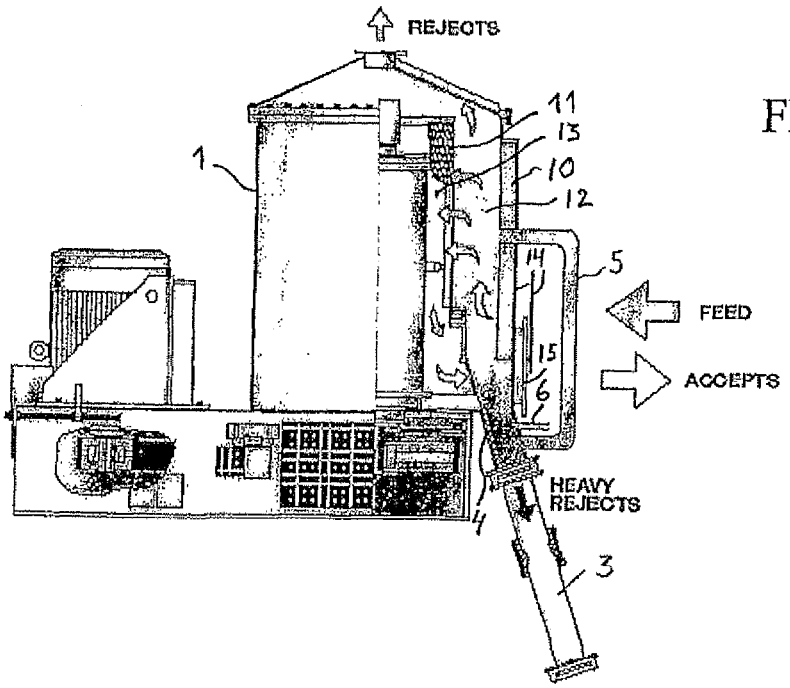
FIG. 4 illustrates an arrangement of the external circulation according to the invention in connection with a typical screening apparatus.

FIG. 4 illustrates a principal scheme of a screening apparatus, wherein a device 4,5 for external circulation has been adapted. The same reference numerals have been used in FIG. 4 as in FIGS. 1-3. The pulp being treated is fed via conduit 14 into feed chamber 12, wherefrom pulp particles flow through openings in the screen drum into accept chamber 13. The accept is removed from the screening apparatus via conduit 15. Reject is removed at the top of the housing via conduit 16. Heavy reject is removed via a conduit having a junk trap 3. The external circulation 4, 5 according to the invention is arranged in connection with heavy reject removal.

Thus, external circulation is utilized, whereby the pulp flow volume going through the device increases and thus improves the junk-separation capability of the device. The location and design of the piping are realized in such a way that the reject particles do not pass together with the flow back into the circulation but remain in the area of calm flow and sink onto the bottom of the device.

The invention is not limited to the illustrated and described embodiments, but many modifications associated thereto are conceivable in the scope defined by the claims. The use and application of the invention is not limited to the screening apparatus construction illustrated in the figures.

The invention claimed is:

1. An arrangement in a screening apparatus of a pulp or paper processing system, the arrangement comprising:

a screening vessel including a vessel sidewall and an inner cylindrical screen;

an inlet to a pulp chamber in the screening vessel to receive pulp or paper, the pulp chamber being between the vessel sidewall and the cylindrical screen;

a first rejects discharge outlet coupled to an upper elevation of the screening vessel, the rejects discharge outlet is in fluid communication with the pulp chamber;

a second rejects discharge outlet in fluid communication with the pulp chamber and coupled to a reject removal conduit for removal of heavy rejects formed in a screening process, wherein, between the reject removal conduit and the pulp chamber, a material circulation passage extends from the reject removal conduit to the vessel sidewall via a conduit external to the screening vessel, wherein the circulation passage connects to the vessel sidewall below the upper elevation of the screening vessel, and further wherein a portion of the reject is removed from the screening apparatus through the reject removal conduit while simultaneously another portion of the reject flows from the removal conduit through the conduit external to the screening apparatus and into the interior of the screening apparatus.

2. An arrangement according to claim 1, wherein a liquid conduit is arranged in an initial part of the conduit for external circulation for improving mixing.

3. An arrangement according to claim 1 wherein a bottom of an initial part of the circulation conduit is lower than a bottom of the screening apparatus.

4. An arrangement according to claim 1 wherein the external circulation is effected by a pressure difference.

5. An arrangement according to claim 1 wherein the screening apparatus is provided with a screen drum rotating inside a housing and an inner surface of the housing is provided with an outer foil, whereby a discharge flow from the external circulation is led through the outer foil into a chamber between the screen drum and the housing.

* * * * *